United States Patent [19]

Correll, Jr.

[11] Patent Number: 4,688,734

[45] Date of Patent: Aug. 25, 1987

[54] APPARATUS AND METHOD FOR TENSIONLESS WINDING OF LOW MODULUS ELASTIC YARNS INTO A CYLINDRICAL PACKAGE FOR UNIFORM DYEING

[75] Inventor: James F. Correll, Jr., Chattanooga, Tenn.

[73] Assignee: Dixie Yarns, Inc., Chattanooga, Tenn.

[21] Appl. No.: 865,986

[22] Filed: May 22, 1986

Related U.S. Application Data

[62] Division of Ser. No. 749,641, Jun. 28, 1985, Pat. No. 4,615,495.

[51] Int. Cl.[4] ..... B65H 54/02; B65H 54/28

[52] U.S. Cl. ..... 242/18 R; 242/43 R; 242/45

[58] Field of Search ..... 242/18 R, 43 R, 45, 242/158 R, 158 F, 158 B, 158.1, 158.2, 158.3, 158.4 R, 158.4 A

[56] References Cited

U.S. PATENT DOCUMENTS

| | | | |
|---|---|---|---|
| 2,302,790 | 0/0000 | Modigliani | 28/283 |
| 2,778,578 | 0/0000 | Keith | 242/18 R |
| 2,786,637 | 0/0000 | Russell et al. | 242/18 R |
| 2,866,424 | 0/0000 | Masland | 112/79 FF |
| 3,141,624 | 0/0000 | Gentle | 242/18 R |
| 3,161,913 | 0/0000 | Pound | 242/153 |
| 3,281,087 | 0/0000 | Claiborne | 242/18 R |
| 3,393,880 | 0/0000 | Keith et al. | 242/45 |
| 3,640,440 | 0/0000 | Sedlarik | 226/34 |
| 3,850,377 | 0/0000 | Pitts et al. | 242/18 R |
| 3,908,920 | 0/0000 | Hermanns | 242/45 |
| 3,944,166 | 0/0000 | Hermanns | 242/147 A |
| 4,052,022 | 0/0000 | Reijnhard | 242/147 A |
| 4,169,565 | 0/0000 | Blok et al. | 242/18 R |

*Primary Examiner*—Stanley N. Gilreath
*Attorney, Agent, or Firm*—Parkhurst & Oliff

[57] ABSTRACT

A low-density, substantially cylindrical, wound package of substantially tensionless, low modulus, highly elastic yarn, preferably having a density of not greater than about 0.300 g/cc. Such packages are made by advancing tensionless yarn through a traversing mechanism in a stream of fluid which is moving in the same direction as the yarn and at a speed greater than the linear speed of the yarn being taken-up on the cylindrical package. Such packages are produced on apparatus for tensionless traversing of yarn wherein the yarn guide on the traversing end of the traversing element comprises the outlet of a fluid jet through which fluid is driven to maintain the tensionless condition of the yarn as it passes through the traversing element and is thereafter wound into a low density, tensionless package.

13 Claims, 2 Drawing Figures

APPARATUS AND METHOD FOR TENSIONLESS WINDING OF LOW MODULUS ELASTIC YARNS INTO A CYLINDRICAL PACKAGE FOR UNIFORM DYEING

This is a division of application Ser. No. 749,641, filed June 28, 1985, now U.S. Pat. No. 4,615,495.

BACKGROUND

The present invention relates to a system for preparing elastic yarns so that they may be batch or package-dyed by methods heretofore typically useful only for dyeing inelastic yarns. More particularly, the present invention relates to an apparatus and method for tensionless winding of low modulus high elasticity yarns into a low density, uniform, wound cylindrical package, and that inventive package itself.

It has been customary in the textile industry to dye or otherwise impart color to yarns by the batch process commonly known a package dyeing. In that process, an entire package, i.e. cone or bobbin of yarn, is batch dyed simultaneously. That package dyeing process was a substantial improvement over other forms of dyeing, and that process has now been used for many years in the textile industry.

However, there remain considerable difficulties in the dyeing of elastic yarns since such yarns typically have no uniform nominal shape, and even very slight tensions can result in substantial deformation of such yarns. If such yarns are wound into packages in the same manner as more inelastic yarns are packaged, the deformation, i.e. extension, which normally occurs, makes such wound packages very tight, dense structures. Such yarn package structures are unsuitable for batch or package dyeing because their density and lack of porosity prevents total penetration of the dyeing medium, and thus results in non-uniform coloration and non-uniform yarn properties after batch or package dyeing.

In the typical yarn winding processes, a perforated cylinder or spring core was rotated about its axis either by direct power to the axis of rotation, or by circumferential contact with another rotating member such as a steel roll. Thus, the yarn was pulled onto the desired cylinder necessarily creating tension in the yarn and extension of the yarn during winding. Such tension and extension are of negligible consequence when winding relatively rigid, inelastic yarns, since the initial modulus of elasticity of such yarns is quite high and the subsequent elongation is so low that it has no serious consequences in the wound package. However, such techniques are not suitable for highly elastic, low modulus yarns because only minor amounts of tension result in very substantial amounts of extension during winding, thus resulting in non-uniformities in the yarn condition as wound in the package, in addition to the yarn package densities which are unsuitable for package dyeing.

As previously indicated, in package dyeing yarn packages are treated with yarn colorants according to standard practices which typically involve passing a liquid medium through the wound package radially in both directions. Such radial injection of liquid colorant into the package is successful only of the package is of sufficiently low density to permit flow of the colorant medium throughout the package, i.e. the colorant medium is able to seek all available paths to contact every portion of every yarn in the package. Thus it is again noted that successful package dyeing makes it quite desirable that the package being dyed be of a density and porosity such that the liquid dyeing medium may easily and efficiently permeate the entire package structure. This goal has historically been substantially impaired where attempts were made to package dye tightly wound packages of low modulus high elasticity yarns.

Other previous attempts have been made to make more porous, less dense, packages of low modulus highly elastic yarns. One such attempt was to wind the yarns on a much larger diameter core and then to allow the core to relax to a size comparable to the core of a normal package. This was commonly done on a collapsible bobbin. Another method was disclosed in Claiborne et al U.S. Pat. No. 3,281,087. Still another method is to use normal winding techniques, but to attempt to supply the yarn loosely to the package being formed by the use of over-feed rolls, thereby reducing the amount of extension and deformation of the yarn. However, in the case of direct winding, there is no way to distribute the yarn uniformly throughout the package without the usual traversing mechanisms which supply the yarn onto a revolving bobbin in a generally spiral pattern. However, the traversing mechanisms which deliver the yarn uniformly into such packages necessarily add tension to the yarn. Thus such prior methods have still not produced satisfactory porous, low density packages of low modulus high elasticity yarns.

BRIEF SUMMARY OF THE INVENTION

It is, therefore, an object of this invention to overcome the aforementioned defects in the prior art.

It is another object of this invention to provide a low density, high porosity, substantially uniform, wound package of substantially tensionless low modulus high elasticity yarn, and to provide such packages which are suitable for batch or package dyeing.

It is another object of this invention to provide a method for substantially tensionless winding of low modulus highly elastic yarns into a uniform, low density, cylindrical package.

It is still another object to provide apparatus for substantially tensionless winding of low modulus, highly elastic yarns into a uniform, low density, cylindrical package.

It is a further object of this invention to provide such apparatus and methods which eliminate multiple handling of such yarns and achieve such tensionless winding and low density packages by direct winding techniques.

The foregoing objects and others are accomplished in accordance with the present invention wherein a low-density, wound package of substantially tensionless, low modulus, high elasticity yarn is produced on apparatus for tensionlessly traversing such yarn into a substantially cylindrical package, such apparatus including a yarn guide/fluid jet combinations structure near the end of a traversing unit which conbination structure includes a fluid jet whose outlet also comprises the outlet of said yarn guide, with means for driving fluid through said jet at speeds sufficient to maintain the yarn in a substantially tensionless condition. By the use of such apparatus, low modulus, highly elastic yarn is wound into such low density, uniform packages which are quite suitable for quality uniform dyeing by standard package dyeing techniques.

BRIEF DESCRIPTION OF THE DRAWINGS

For a better understanding of the invention as well as other objects and further features thereof, reference is made to the following detailed disclosure of preferred embodiments of the invention taken in conjunction with the accompanying drawings thereof, wherein.

DETAILED DESCRIPTION

The present invention comprises an apparatus for, and a. method of tensionless traversing and winding of elastic yarn, i.e., yarn having low modulus of elasticity, into a substantially cylindrical package, and the resultant low density package of tensionless, non-extended, low modulus elastic yarn which is most suitable for use in uniform dyeing of such yarns.

Figure 1:
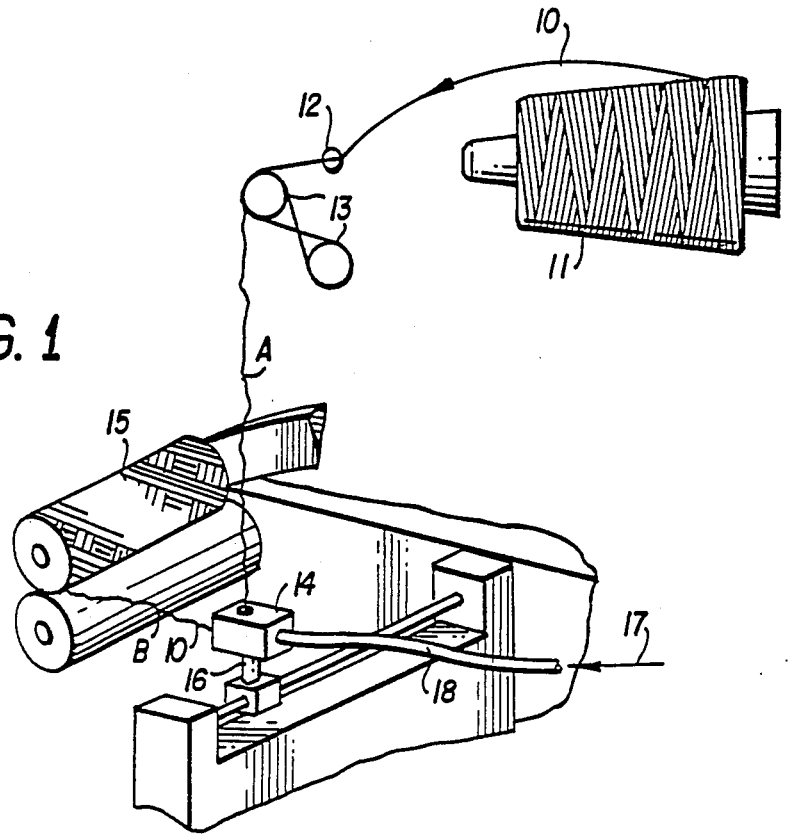
FIG. 1 is a partially schematic view of the apparatus of the present invention showing the yarn path in the inventive method of the present invention.

FIG. 1 illustrates the apparatus of the present invention in partially schematic form which also illustrates the path of yarn being treated according to the method of the present invention. The feed yarn 10 is typically available in previously wound yarn cones, bobbins, or other packages upon which the yarn has been wound, with tension, and thus extended. Yarns suitable for use in the system of the present invention can take various forms. One possible form is a continuous filament synthetic material which is either elastomeric, or has had stretchability imparted thereto. Thus the ability to be elastically elongated can be inherent in the material itself, or be induced in the material of which the yarn is made. For example, low modulus, high elsticity yarns such as Dupont's Lycra as disclosed in U.S. Pat. Nos. 2,813,775, 2,813,776, 2,857,852, and 2,999,839 or other such spandex-type yarns, may be used in the bare or covered form. Similarly, other elastic yarns, such as crimped nylon yarns or any other suitable elastic yarn may be used. When covered or composite elastomeric yarns are used, the aforementioned low modulus, highly elastic materials are incorporated into a yarn structure in which those materials provide the elasticity of the composite yarn, while the remainder of the structure is present for other desirable properties such as appearance, feel, and ultimately for the comfort of the wearer of any garment in which such yarns are incorporated. Such composite yarns typically have both the aforementioned elastic portion, as well as a non-elastic portion which may be wrapped, twisted, or wound around the elastomer, either as a separate yarn structure, or in the form of fibers which are spun into place as a cover sheath around the elastomeric portion of the yarn. Alternatively, the elastic and relatively inelastic cover portions of the composite yarn may be twisted together.

While the foregoing description of the materials which may be processed in the system of the present invention relates primarily to textile yarns, it will be appreciated that the inventive system may be applicable to virtually any substantially continuous filamentary elastic material, such as rubber strand, bands, elastic rope or any such analogous material.

In order to dye such elastic or elastic containing yarns uniformly in conventional batch or package-dyeing operations, it is preferable to have such yarns in a virtually fully relaxed condition, and to have the density of such packages sufficiently low so that dye solutions or mixtures can fully penetrate the entire volume of any package being batch or package-dyed. Before the present invention, the formation of low density packages in which low-modulus highly elastic yarns were wound in a virtually tensionless, non-extended condition, was unknown, particularly in any substantial yarn volumes.

Returning now to the apparatus and method as illustrated in FIG. 1, feed yarn 10 is supplied from an existing standard cone or package 11 of yarn, and the yarn which emerges from that cone is drawn through a guide 12 which is a part of a known, variable or fixed overfeed roll system 13, such as that manufactured by Conorapid, a West German manufacturer. Over-feed rolls 13 withdrawn yarn from cone or package 11 at a faster rate than they dispense yarn toward location A in the yarn path, downstream of the overfeed rolls 13. Thus, the yarn downstream of point A would be free of tension if its velocity remained unchanged by any interferences, and theoretically could be wound upon a package 15 without tension if the circumferential velocity of package 15, i.e. its take-up speed, was not greater than the exit velocity of the yarn from overfeed rolls 13. However, in order to form package 15 uniformly, it is necessary to traverse the yarn along the length of the desired package 15 as that package is being wound, and such traverse mechanisms typically include a guide (like guide 12) or similar structure over which the yarn frictionally passes, creating tension in the yarn before it is wound on package 15, thus destroying the desired tensionless state of the yarn as it is formed into package 15.

In the advantageous system of the present invention, the traversing mechanism has been successfully modified to eliminate the tension-creating effects of any friction between yarn and the guide of the traversing mechanism by providing a yarn guide portion of the traversing mechanism in combination with a fluid jet wherein the fluid jet outlet also comprises the outlet of the yarn guide of the traversing mechanism, with means for driving fluid through said jet at sufficient speed with respect to the intended take-up speed of yarn to be passed therethrough, thus permitting such yarn to be wound into a substantially tensionless cylindrical package in which the yarn is substantially uniformly distributed while maintaining its virtually tensionless condition. In FIG. 1 these portions of the apparatus of the present invention are schematically illustrated as yarn guide/fluid jet structure 14 mounted at the guide portion of traversing mechanism 16, with fluid, such as air, being supplied through the yarn guide/fluid jet 14 via tube 18, the exit of yarn guide/fluid jet 14 also comprising the exit for yarn 10, which at position B between the traversing mechanism and package 15 retains its virtually tensionless state, and is then wound upon and uniformly traversed throughout package 15 in that highly desirable virtually tensionless state.

The yarn characteristics, yarn overfeed speed, traversing speed, yarn jet fluid pressure, and yarn take-up speed may be adjusted as desired to optimize production of uniform, low density, tensionless packages according to the present invention.

Figure 2:
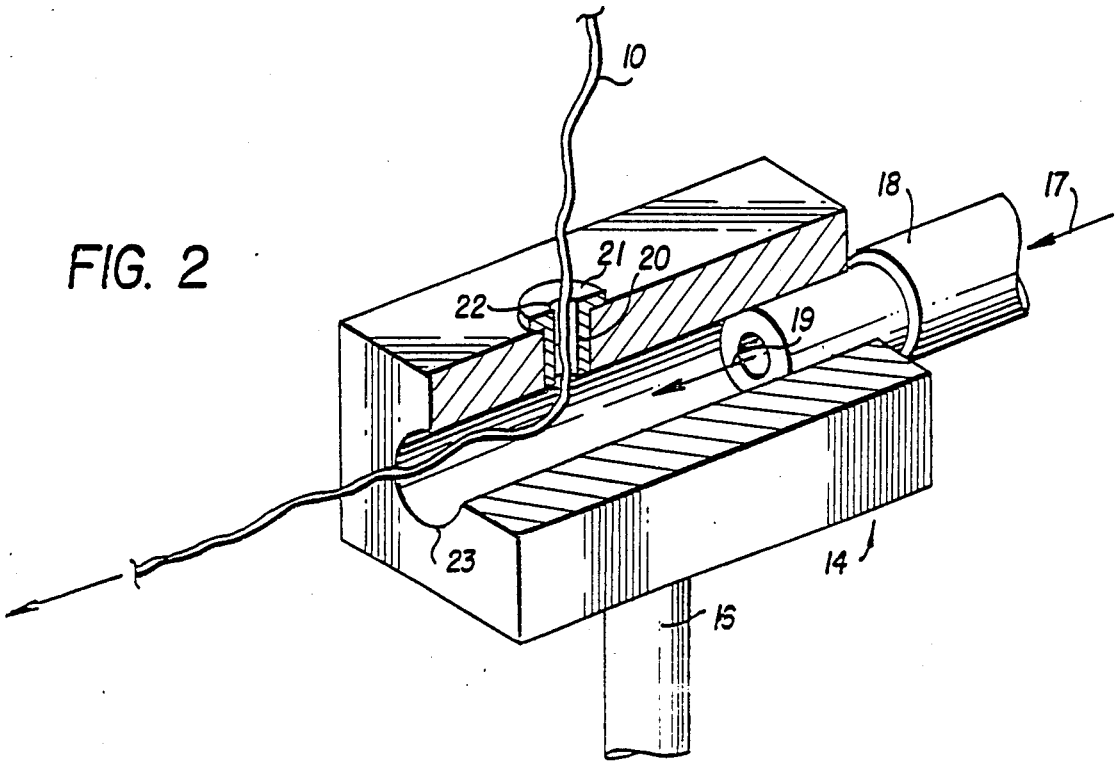
FIG. 2 is a partially schematic, cut-away view of the yarn guide/fluid jet portion of the traverse mechanism according to the present invention.

The structure of the yarn guide/fluid jet 14 is shown in more detail in the partially cut-away view of FIG. 2, wherein the yarn guide/fluid jet 14 is shown in the form of a parallelopiped block of relatively solid material, such as solid plastic like polyethylene, through which fluid passage 19 passes, fluid passage 19 being intersected by yarn inlet passage 20, here shown entering block 14 from the top. Any other similar structure or material may be used. Preferably, passage 20 may include a ceramic yarn guide 21 having inlet bore 22 therein to avoid any frictional effects as the yarn passes through the surfaces of openings 20, 22 and turns toward exit 23 of fluid passage 19. At the other end of fluid passage 19, yarn guide/fluid jet 14 is connected to tube 18 through which fluid, such as compressed air, enters the yarn guide/fluid jet 14. Tube 18 is preferably quite flexible so that the rapid traverse movements of traversing mechanism 16 are in no way impaired by the presence of tube 18 which is connected to the guide portion of traversing mechanism 16. For example, a flexible, lightweight polyethylene tube, or any other suitable flexible tube, may be used for tube 18.

The pressure of the fluid 17, usually air, fed to fluid passage 19 of yarn guide/fluid jet 14 may be varied, depending upon the characteristics of the specific yarn being processed in the advantageous system of the present invention. However, the velocity of fluid 17 is always maintained sufficiently high so that the linear speed of yarn 10 leaving exit 23 of yarn guide/fluid jet 14, i.e. at point B in FIG. 1, is no higher than the linear speed of yarn 10 entering yarn guide/fluid jet 14, for example the yarn speed at point A as illustrated in FIG. 1. However, that fluid pressure and resultant fluid velocity are maintained at levels such that further air is inducted through inlet bore 22, along with yarn 10, thus advancing the overfed, tensionless yarn 10 through the yarn traversing mechanism while preserving its substantially tensionless state.

In this way, the linear yarn speed at the time the yarn is taken-up onto package 15, i.e., the linear yarn speed in region B as illustrated in FIG. 1, is such that as the yarn is traversed and wound into package 15 there is virtually no tension in the yarn, thereby resulting in a uniform, cylindrically wound package of tensionless, low modulus, high elasticity yarn having uniform but low density, which tensionless, low density package is ideally suited for package dyeing.

Where the yarn formed into such uniform, low density, tensionless wound packages is cotton covered spandex, i.e., Lycra covered with spun cotton or a twisted cotton covering thread, such packages have a density of not greater than about 0.30 g./cc. The preferred densities of such packages are in the range of about 0.10–0.25 g./cc, and particularly preferably in the range of 0.140–0.20 g./cc.

The following examples illustrate the use of the apparatus and method, and describe the resultant product, of the system of the presently claimed invention. The apparatus used in all the following examples is the apparatus heretofore described in conjunction with FIGS. 1 and 2 herein. It will be understood by those skilled in the art that the following examples are intended to be illustrative of the present invention, and are not intended to be limiting.

EXAMPLES I–VI

The apparatus illustrated and described in conjunction with FIGS. 1 and 2 herein was used with the yarns, and under the conditions described in the following table, to provide low density wound cylindrical packages of virtually tensionless low modulus, highly elastic yarns.

| EXAMPLE: | I | II | III | IV | V | VI |
|---|---|---|---|---|---|---|
| Yarn/ Condition | | | | | | |
| Ne[1] | 26/1 | 26/1 | 26/1 | 17/1 | 20/1 | 50/1 |
| denier[2] | 70 | 70 | 70 | 40 | 140 | 40 |
| % cover | 91 | 91 | 91 | 96 | 89 | 89 |
| % elastomer[3] | 9 | 9 | 9 | 4 | 11 | 11 |
| Draft[4] | 4.0 x | 4.0 | 4.0 | 3.5 | 5.0 | 3.5 |
| Yarn Take-Up Speed | 199 M/min | 199 | 199 | 199 | 199 | 199 |
| Yarn Over-Feed Speed | 367 M/min | 550 | 734 | 367 | 367 | 367 |
| Air Pressure | 2.5 psi | 1.9 | 2.5 | 1.25 | 3.75 | 2.5 |
| Product Package Wt. | ~500 g | ~500 g | ~500 g | ~500 g | ~500 g | ~500 g |
| Yarn Density[5] on Package | 0.187 g/cc | 0.174 | 0.144 | 0.170 | 0.195 | 0.218 |

NOTES:
[1]English Cotton Count of the total yarn structure.
[2]Denier of the elastometer; Dupont Lycra.
[3]On weight basis.
[4]The number of times the elastometer was extended from its original length in the process of covering the core with cover fibers.
[5]The weight of the yarn on the cylinder divided by its measured volume.

The uniform, low-density packages of tensionless low modulus, high elasticity yarns produced in each of the foregoing examples were then successfully dyed using standard batch or package-dyeing techniques. After dyeing, yarn samples from each of the packages were divided into sample increments of varying lengths. The increments were compared for elastic elongation and recovery properties and for evenness of coloration after dyeing. Those tests demonstrated that the apparatus and method of the present invention produced a low density, uniformly wound cylindrical package of low modulus elastic yarn, which, when dyed, maintained its elastic elongation and recovery characteristics, and was uniformly dyed throughout.

It will be understood that various other changes of the details, materials, steps, arrangements of parts and uses which have been herein described and illustrated in order to explain the nature of the invention will occur to and may be made by those skilled in the art upon a reading of this disclosure, and such changes are intended to be included within the principles and scope of this invention.

What is claimed is:

1. A yarn traversing apparatus for substantially tensionless traversing of continuous filamentary material, such as yarn, onto a cylindrical package upon which said material is to be wound, comprising:

a combination yarn guide/fluid jet member mounted for traversing the length of a cylindrical yarn package, wherein an outlet of the fluid jet also comprises an outlet of said yarn guide; and means for driving fluid through said jet at a speed higher than a corresponding take-up speed of yarn to be taken up on the cylindrical package.

2. The apparatus of claim 1, wherein there are no elements for contacting the yarn located between the outlet of the yarn guide/fluid jet and the substantially cylindrical package of said yarn being formed.

3. The apparatus of claim 1, wherein said yarn guide/fluid jet member comprises a member having a fluid passage therethrough with fluid driving means connected at an end of said passage opposite said outlet, and a yarn inlet passage.

4. The apparatus of claim 3, wherein the yarn inlet passage connects with said fluid passage at a point between the ends of said fluid passage.

5. The apparatus of claim 4, wherein a ceramic yarn guide is located within said yarn inlet passage.

6. The apparatus of claim 1, wherein said yarn guide/fluid jet member comprises a solid piece of plastic having said fluid passage therethrough.

7. The apparatus of claim 6, wherein said yarn guide/fluid jet member comprises polyethylene.

8. The apparatus of claim 4, wherein the bottom of the yarn guide/fluid jet member is attached to a traversing element, the fluid passage extends substantially horizontally through the yarn guide/fluid jet member and the yarn inlet passage enters the top of the yarn guide/fluid jet member.

9. The apparatus of claim 1, wherein the means for driving fluid through said jet comprises a flexible tube fluid supply means connected to one end of said fluid passage.

10. A method for winding continuous filamentary material such as yarn into a low density, substantially tensionless, cylindrical package, comprising the steps of:

taking-up tensionless, continuous filamentary material by winding same on a substantially cylindrical tube upon which said yarn is substantially uniformly traversed throughout the length of a package;

supplying said yarn to a traversing mechanism;

traversing said yarn along said tube with the traversing mechanism;

advancing said yarn through said traversing mechanism for take-up on said tube, the linear yarn speed of yarn being supplied to said traversing mechanism being greater than the linear speed at which yarn is taken-up on said tube;

said yarn advancing being in a stream of fluid which is moving in the same direction as said yarn and at a speed greater than the linear speed of the yarn being taken-up on said tube, thereby advancing said yarn through said traversing mechanism and onto said tube without extending same or imparting tension thereto.

11. The method of claim 10, wherein said fluid is air.

12. The method of claim 10, wherein said material is a spandex-type yarn.

13. The method of claim 10, wherein said material is a spandex-type yarn covered with a relatively inelastic material.

* * * * *